US007307497B2

(12) United States Patent
Joodaki

(10) Patent No.: US 7,307,497 B2
(45) Date of Patent: Dec. 11, 2007

(54) METHOD FOR PRODUCING A COPLANAR WAVEGUIDE SYSTEM ON A SUBSTRATE, AND A COMPONENT FOR THE TRANSMISSION OF ELECTROMAGNETIC WAVES FABRICATED IN ACCORDANCE WITH SUCH A METHOD

(75) Inventor: Mojtaba Joodaki, Munich (DE)

(73) Assignee: Atmel Germany GmbH, Heilbronn (DE)

( * ) Notice: Subject to any disclaimer, the term of this patent is extended or adjusted under 35 U.S.C. 154(b) by 41 days.

(21) Appl. No.: 11/122,010

(22) Filed: May 5, 2005

(65) Prior Publication Data

US 2005/0248421 A1 Nov. 10, 2005

(30) Foreign Application Priority Data

May 5, 2004 (DE) ..... 10 2004 022 177

(51) Int. Cl.
*H01P 3/08* (2006.01)

(52) U.S. Cl. ..... 333/238; 333/246

(58) Field of Classification Search ..... 333/1, 333/238, 246

See application file for complete search history.

(56) References Cited

U.S. PATENT DOCUMENTS

| | | | | |
|---|---|---|---|---|
| 2,800,634 | A * | 7/1957 | Engelmann et al. | 333/238 |
| 5,796,321 | A | 8/1998 | Caillat et al. | |
| 5,990,768 | A * | 11/1999 | Takahashi et al. | 333/247 |
| 6,287,885 | B1 | 9/2001 | Muto et al. | |
| 6,888,427 | B2 * | 5/2005 | Sinsheimer et al. | 333/238 |

OTHER PUBLICATIONS

Linda P.B. Katehi et al., "Novel Micromachined Approaches to MMICs Using Low-Parasitic, High-Performance Transmission Media and Environments", The Radiation Laboratory-The University of Michigan, Ann Arbor, MI 48109, 1996 IEEE MTT-S Digest, pp. 1145-1148.

* cited by examiner

*Primary Examiner*—Benny Lee
(74) *Attorney, Agent, or Firm*—Geissler, Olds, Lowe, and Richardson

(57) ABSTRACT

A component for the transmission of electromagnetic waves and a method for producing such a component is provided, whereby conductors of a coplanar waveguide system are embedded in a membrane such that they are at least partially suspended across a back-etched area of the substrate for the decoupling of the conductors from the substrate (1). An additional substrate is connected to the bottom side of the back-etched area of the substrate in such a way that a hollow cavity is formed.

39 Claims, 7 Drawing Sheets

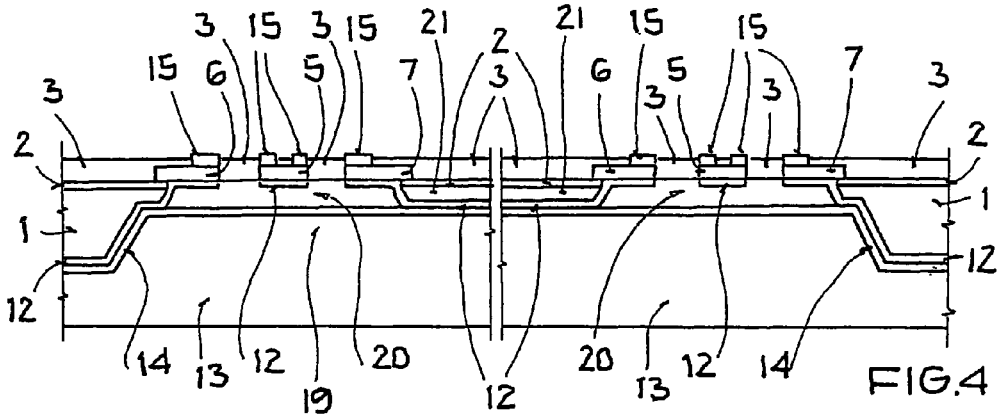
FIG.4
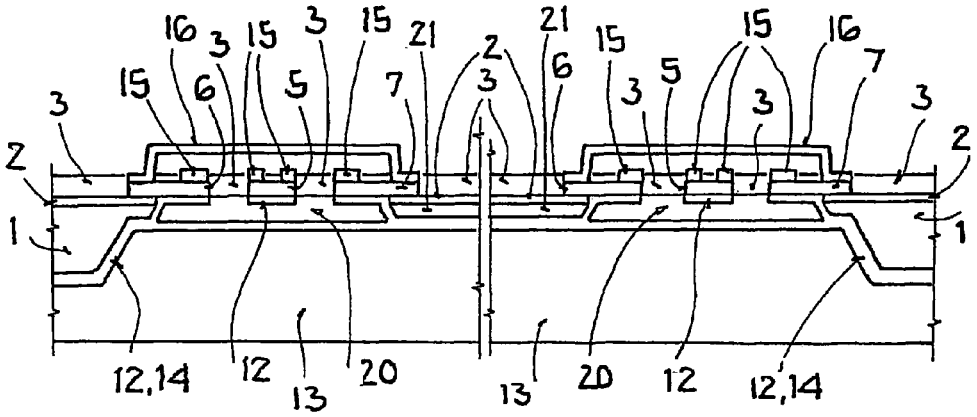
FIG.6
FIG.5
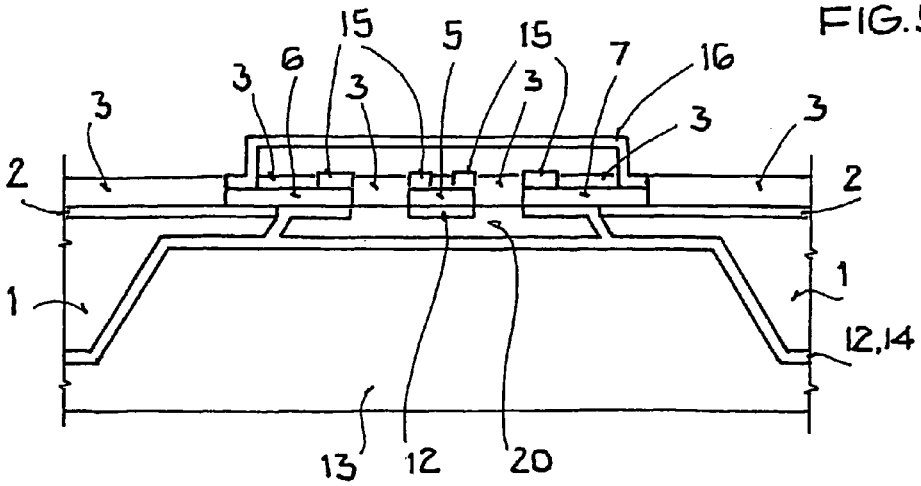

METHOD FOR PRODUCING A COPLANAR WAVEGUIDE SYSTEM ON A SUBSTRATE, AND A COMPONENT FOR THE TRANSMISSION OF ELECTROMAGNETIC WAVES FABRICATED IN ACCORDANCE WITH SUCH A METHOD

This nonprovisional application claims priority under 35 U.S.C. § 119(a) on German Patent Application No. DE 102004022177.4, which was filed in Germany on May 5, 2004, and which is herein incorporated by reference.

BACKGROUND OF THE INVENTION

1. Field of the Invention

The present invention relates to a method for producing a coplanar waveguide system on a substrate for the transmission of electromagnetic waves and a component fabricated in accordance with such a method.

2. Description of the Background Art

With increasing operating frequency, component modeling of components integrated on a semiconductor substrate is playing an increasingly bigger role because it causes transmission-line characteristics, reflections on discontinuities, overlapping and dissipation to increase. That makes it generally imperative to consider these effects in the modeling process, particularly in the high frequency field. Particularly with a low-resistance substrate, for example, a silicon substrate, the parasitic influence of the substrate conductivity and additional capacitance must not be neglected.

Although generally applicable to any circuit line or any passive component, the present invention and the problems it is based on are described in detail with regard to a coplanar waveguide (CPW).

Since technology in the radio frequency field is shifting from big systems with a wide transmission range to smaller systems with a more limited range, and more and more newer systems are mobile ones, the trend in the RF field is to build radio-frequency-suitable apparatuses that are more economical and easier to use. In recent years, so-called coplanar wave guides, which have considerable advantages over the conventional micro-strip technology, have therefore been explored with increasing frequency. For example, dispersion due to power transfer by air is lower with a coplanar waveguide system, and parasitic interferences, for example, discontinuities, are lower than with conventional micro-strip devices. Furthermore, no through holes are required, so that the mechanically non-stable semiconductors do not have to be of such an extremely thin construction.

The coplanar wave guide is a planar three-line system, generally comprised of a signal conductor and two grounding conductors that are symmetrically arranged thereto. The coplanar wave guide, in correspondence with the three conductors, has two fundamental waves that are commonly referred to as coplanar mode and slot line mode. From a technical viewpoint, however, only the coplanar mode is desired, therefore, air bridges always have to be in place to prevent the second mode from spreading.

According to conventional technology, such a coplanar waveguide generally includes three metal strips, which extend parallel to one another and are embedded in a silicon oxide layer, for example. The oxide layer between the metallization and the low-resistance carrier substrate must thereby be as thick as possible in order to keep the substrate losses as low as possible.

The disadvantage of this conventional approach, however, has proven to be the fact that by direct coupling of the coplanar wave-guide system, that is, the individual conductors of the coplanar wave guide with the dielectric layer, that is, the substrate, high line transmission losses, high substrate losses and minimal muting of the interactions of the individual modes with each other occur. Thus, undesired effects like emission, cross coupling of signals, or oscillations of amplifier circuits etc. occur, particularly in the high frequency field.

It is therefore generally desirable to keep the conductor losses of a coplanar waveguide system as low as possible. In a conventional approach, a micro-screened line system was constructed, whereby a middle of the signal conductor and the grounding conductors arranged parallel thereto are at least partially surrounded by air, whereby the individual conductors are supported by a 1.5 μm-thick membrane, for example, whereby an air gap is provided below the membrane. Thus, a single mode, that is, wave propagation over a very wide band range with reduced dispersion and a reduced dielectric loss can be achieved. With a metallized shielding cavity below the line system, couplings between neighboring lines and interference modes in the substrate are reduced.

The disadvantage of this conventional approach, however, has proven to be the fact that the conventional fabrication of a micro-screened coplanar wave guide depends on the technology for the fabrication of the thin dielectric membrane and also on the anisotropic etching process of the carrier substrate. The conventionally used membrane is composed of a three-layer construction of $SiO_2$—$Si_3N_4$—$SiO_2$. The production method of such a three-layer-construction is costly and complicated and requires at least two steps. To start with, an opening in the silicon nitrate layer on the back side of the substrate is defined and subsequently, the substrate is back-etched until a transparent membrane evolves. Next, various geometries suitable for micro-screening are formed by using photolithography. Thus, this production method is labor-intensive and costly, whereby the metallizations can only be made relatively thin resulting in high line transmission losses and high electrical resistance values.

In addition, this conventional approach has the disadvantage that the upper grounding points and the lower mass conductors are not directly interconnected but are separated from one another by a dielectric layer. Thus, the individual grounding points have to be grounded separately from one another, which requires additional expenditure in labor.

SUMMARY OF THE INVENTION

It is therefore an object of the present invention to provide a production method for micro-screened coplanar wave guides, and a component fabricated in accordance with such a method in order to eliminate the above-described disadvantages and in particular, to ensure a simpler and more cost-effective method as well as a component with lower electrical losses and simpler grounding.

The present invention is based on the idea that an improved integration of the individual conductors of the coplanar waveguide system and a direct connection of the upper and lower grounding points as well as an increased thickness of the individual conductors of the coplanar wave guide achieved in an uncomplicated manner, is ensured with the following steps: Construction of at least one coplanar waveguide system, preferably comprised of one signal conductor and two grounding conductors, on a predefined area of the substrate; forming a dielectric insulating layer over the individual conductors of the coplanar waveguide system; complete back-etching of an area of the substrate below the coplanar waveguide system beginning at the bottom side of the substrate in such a way that the signal conductor of the coplanar waveguide system is supported completely, and each grounding conductor is supported at least partially by embedding in the second dielectric insulating layer, while being freely suspended across the completely back-etched area of the substrate; and structured metallizing of the surface of the back-etched area of the substrate and of the segments of the individual conductors of the coplanar waveguide system located above the completely back-etched area, beginning at the bottom part of the substrate, for forming a signal conductor of increased thickness and grounding conductors of at least partially increased thickness.

By using this simple and cost-effective production method, a component for the transmission of electromagnetic waves is produced, whereby the conductors are completely protected from external influences without additional covering, and whereby the signal conductor is completely decoupled from the substrate such that no electromagnetic coupling with the substrate and, therefore, with other conductors, that is, other components, can occur. Thus, interferences and electromagnetic losses can be reduced or entirely eliminated.

In addition, the upper grounding conductors of the coplanar wave guide are directly connected with the lower mass metallization so that only a uniform mass connection needs to be provided.

Furthermore, the signal conductor is constructed, in a simple way, with a thickness that is greater than that of a conventional component. This has the advantage of reducing the electromagnetic losses and the electrical resistance of the signal conductor.

Additionally, the present component is suitable for monolithic integration of the coplanar waveguide system in the radio frequency field, that is, the high frequency field for silicon-based technologies. Thus, the overall performance of the component is improved, whereby the component can be produced in a more cost-efficient way due to a simpler production method.

In an example embodiment, an additional layer, particularly a first dielectric insulating layer, can be formed on the top side of the substrate before the conductor is constructed. This additional layer can beneficially serve as protection of the conductor metallizations from possible etching agents.

In a further example embodiment, lower grounding conductors are formed, starting at the bottom side of the substrate by structural metallization of the surface of the back-etched areas of the substrate and the segments of the individual conductors of the coplanar waveguide system, which are located above the completely back-etched area, whereby each of the lower grounding conductors is connected with the segments of the corresponding grounding conductors, which are located above the completely back-etched areas of the substrate. In this way, a direct connection of the upper and lower grounding conductors is achieved without the disadvantageous dielectric intermediate layer. Thus, an altogether uniform mass connection can be accomplished, which can be done in a more cost-efficient way. Additionally, the thickness of the signal conductor can be increased by the metallization so that the electrical resistance of the signal conductor is beneficially reduced.

It is beneficial to do the complete back-etching of an area of the substrate below the respective conductor path with a single wet chemical etching procedure, for example, by utilizing a third insulating layer. Alternatively, it can be beneficial to carry out the complete back-etching of the area of the substrate below the respective coplanar wave guide in two consecutive etching steps. In a first etching step, an area of the substrate below the respective coplanar wave guide can be partially back-etched in such a way that a thin substrate layer below the respective coplanar wave guide remains. In a subsequent second etching step, a segment of the previously formed thin substrate layer can be completely back-etched again using, for example, a wet chemical etching procedure, to form a staggered structure on the back-etched area of the substrate below the respective coplanar wave guide. In this way, several neighboring coplanar waveguide systems can be produced simultaneously on a limited surface by using the two previously described etching steps, whereby not completely back-etched segments of the previously formed thin substrate layer ensure a greater stability of the substrate surface. Both the first and second etching step in particular can be executed as a wet chemical etching process. During the second etching step, for example, an additional insulating layer on the bottom side of the substrate and the surface of the partially back-etched segment is deposited, whereby the fourth insulating layer structured by developing, for example, a vapor-deposited photoresist material, in order to ensure the desired anisotropic complete back-etching of a segment of the previously formed thin substrate layer. As a final treatment, the photoresist layer, for example, can be rinsed off with a suitable solution, for example, acetone, and the insulating layers remaining on the bottom side of the substrate can be removed by using, for example, a wet chemical etching procedure or a dry etching procedure.

In yet another example embodiment, an additional substrate of a suitable geometry can be mounted to the bottom side of the processed substrate for forming an air gap. Due to the favorable dielectric constants of air, a good shielding of the signal conductor to the substrate and to further adjacent conductors is thus provided. In this way, substrate losses and electromagnetic losses can be reduced. The additional substrate can be provided with a metallization on its surface, which can be interconnected with the lower grounding conductors, at least in part. Thus, the resistance of the lower grounding conductors can also be reduced and a mechanically stable connection can be made.

The geometry of the additional substrate can be such that it can be inserted in the partially back-etched area, at least in part. Thus, a well-shielded hollow cavity and an excellent decoupling of the signal conductor from the substrate and from adjacent conductors is once again achieved. Furthermore, the surface of the additional substrate can also have a metallization, which can be connected to the lower mass metallization of the processed substrate. In this way, the electrical resistance of the grounding conductors is considerably reduced and the stability of the entire component is increased.

According to a further preferred embodiment, a photoresist layer, that is, a photolacquer, is formed on the surface of the back-etched area of the substrate prior to the structured metallization and is illuminated, that is, developed accordingly. The photolacquer is a simple variation of a mask for a structured metallization of the substrate.

Preferably, both the signal conductor in the areas that are facing the grounding conductors and each grounding conductor in the areas that face the signal conductor can be further metallized for additional thickness. These areas of the conductors have the highest current density so that it is beneficial for the conductors to be thicker in these areas than in the remaining areas.

In a further embodiment, a covering metallization can be formed over the coplanar waveguide system, which extends from one grounding conductor to the opposing grounding conductor in a lid-shaped fashion, thus connecting the conductors with one another. This results in a completely shielded coplanar waveguide system and a uniform grounding line for the entire system. Furthermore, the signal line is shielded from external interferences and dirt.

For example, several coplanar waveguide systems can be provided on a shared substrate adjacent to one another, whereby the substrate is subjected to collective method steps for forming the respective hollow cavities and the metallizations. In this way, the individual coplanar waveguide systems does not need to be produced separately, instead, all coplanar waveguide systems can be cost-effectively produced at the same time by applying collective method steps. For example, each of the facing grounding conductors of adjacent coplanar waveguide systems are electrically connected with one another via the lower grounding conductor that was formed by structured metallization. Once again, one uniform grounding point is sufficient.

In particular, the substrate is a silicon semiconductor substrate. The individual conductors are preferably made of aluminum, copper, silver, gold, titanium, or the like, and are constructed as conductors suitable for use in the high frequency field.

In a further preferred embodiment, the dielectric insulating layer, with the exception of the membrane, are made of an inorganic insulation material, for example, a silicon oxide, particularly a silicon dioxide, silicon with buried air gaps, silicon nitride, or the like.

The dielectric insulating layer serving as a membrane can be made of an organic insulation material, for example, an organic polymer material, for example, benzocyclobutene (BCB), SiLK resin, SU-8 resist, polyimide, or the like.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 4 is a cross-sectional view of a component in accordance with a fourth embodiment of the present invention;

FIG. 5 is a cross-sectional view of a component in accordance with a fifth embodiment of the present invention; and FIG. 6 is a cross-sectional view of a component in accordance with a sixth embodiment of the present invention.

DETAILED DESCRIPTION OF THE INVENTION

Figure 1A:
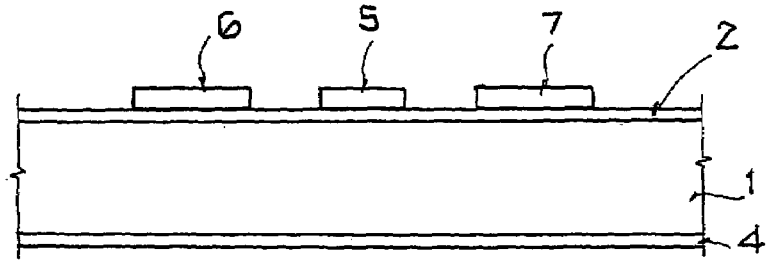
FIGS. 1*a* to 1*i* are cross-sectional views of a component of the present invention in various stages of the method to illustrate the individual method steps in accordance with a first embodiment of the present invention.

Identical reference numerals in the figures designate identical components or components having the same functions, unless indicated otherwise.

FIGS. 1*a* to 1*i* illustrate cross-sectional views of a component in individual method stages, whereby in FIGS. 1*a* to 1*i*, the production method of a component for the transmission of electromagnetic waves according to a first embodiment of the present invention is described in detail.

As is shown in FIG. 1*a*, in a known method step for producing a finite ground coplanar wave guide (FGCPW), for example, the top side and the bottom side of a substrate 1 are provided with a first dielectric insulating layer 2, that is, with an additional dielectric insulating layer 4 (henceforth referred to as third insulation layer 4), which in certain instances can also be omitted. The substrate 1 is, for example, a low-resistance silicon semiconductor substrate, or the like. The first and third dielectric insulating layer 2, or 4, can be formed as an approximately 1-2 μm-thick silicon nitride or silicon dioxide layer, for example. Subsequently, a signal conductor 5 and two grounding conductors 6 and 7 are metallized on the first dielectric insulating layer 2 for forming a coplanar waveguide system. The grounding conductors 6 and 7, respectively, are provided on the sides opposing the signal conductor 5 and extend approximately in parallel with the signal conductor 5. Aluminum has proven to be a particularly suitable material for the conductors 5, 6 and 7 of the coplanar waveguide system. However, other materials, for example, copper, gold, silver, titanium, or the like can also be used.

Figure 1B:
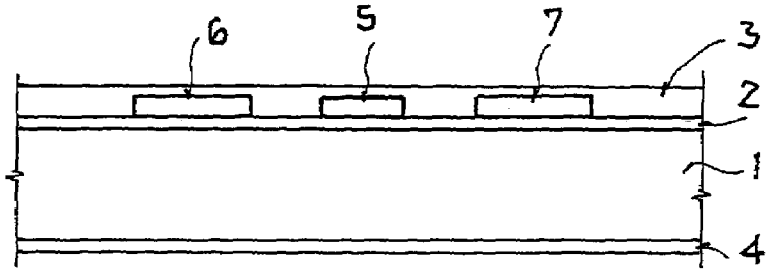

Next, as illustrated in FIG. 1*b*, a second dielectric insulating layer 3 is formed over the first dielectric insulating layer 2 and over the conductors 5, 6, and 7 of the coplanar waveguide system such that the individual conductors 5, 6, and 7 are completely embedded in the second dielectric insulating layer 3.

The second insulating layer 3 serves as a carrier membrane and is preferably made of the material SU-8, which, for example, is centrifuged onto the top side of the substrate 1, and is subsequently subjected to a temperature treatment for hardening. SU-8 is a negative photolacquer, that is, a negative photoresist, which has excellent characteristics for microwave applications. It is noted at this point that it is very difficult to remove the second insulating layer 3 (e.g.. a SU-8 layer) formed on the surface of the substrate 1 once it is hardened. Therefore, the second insulating layer 3 (e.g.. a SU-8 layer) should be pre-structured and pre-etched in suitable areas for possible future metallization. A further advantage of the SU-8 material is that it is robust against anisotropic etching solutions, for example, KOH. The second dielectric insulating layer 3 that serves as a membrane can also be made, for example, of an organic polymer material, particularly benzocyclobutene (BCB), a SiLK resin material, a polyimide, or the like.

In addition, a protective layer can be applied to the second dielectric insulating layer 4, which preferable is resistant to solutions that are used in further method steps, particularly etching agents, thus protecting the SU-8 layer.

Figure 1C:
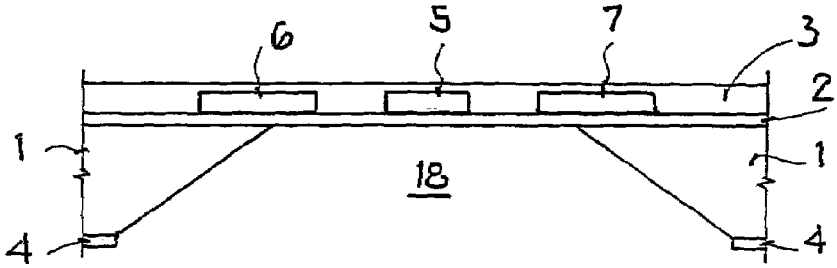

As is illustrated in FIG. 1*c*, a conventional wet chemical etching procedure, for example, using a KOH solution, is then applied to the bottom side of the substrate 1, to completely back-etch the bottom side of the substrate 1 to the first dielectric insulating layer 2 such that the substrate 1 below the entire signal conductor 5 and below both grounding conductors 6 and 7 are completely back-etched, at least over a defined segment of the grounding conductors 6 and 7.

Prior to this defined etching procedure, the third dielectric insulating layer 4 is suitably patterned using a suitable method, for example, a dry etching method.

As is also shown in FIG. 1*c*, the result of the anisotropic etching procedure is a completely back-etched area 18 of the substrate 1, which has an inclined peripheral surface due to the anisotropic characteristic.

The preferably used SU-8 material is stable against an anisotropic etching agent, for example, KOH. Thus, the silicon substrate 1 below the coplanar waveguide system can be back-etched in a simple manner using a conventional KOH wet etching procedure without damaging the SU-8 membrane or second insulating layer 3. Furthermore, the first dielectric insulating layer 2 also serves as a dielectric protective layer for the metallizations 5, 6 and 7 against the KOH etching agent.

Figure 1D:
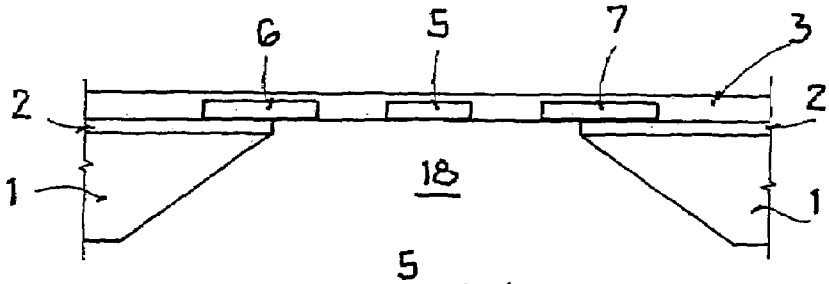

In a subsequent step, the remaining segments of the third dielectric insulating layer 4 on the bottom side of the substrate 1 and the area of the first dielectric insulating layer 2, which covers the completely back-etched area 18, are removed by using, for example, a dry etching procedure. This step is schematically illustrated in FIG. 1*d*.

Figure 1E:
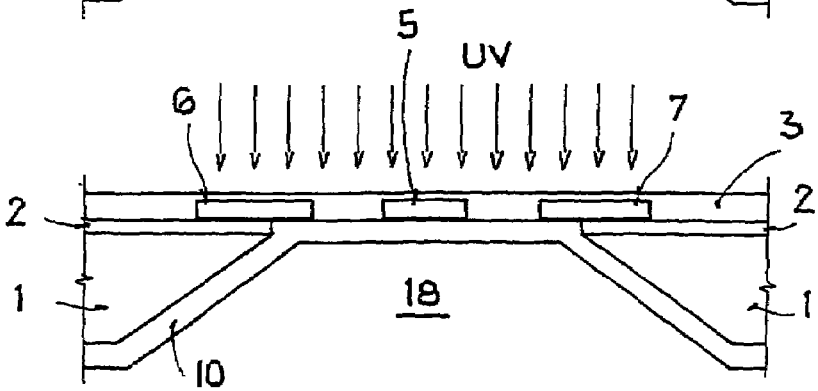

As is illustrated in FIG. 1*e*, a photolacquer 10, for example, a negative photolacquer 10, is then formed on the surface of the back-etched area 18 and the bottom side of the segment of the SU-8 layer or second insulating layer 3 that covers the back-etched area 18, starting at the bottom side of the substrate 1 and using, for example, a centrifugal technique. It will be obvious to one skilled in the art that instead of a negative photolacquer, a positive photolacquer with suitable method steps can also be used In the same way.

It is noted at this point that in all figures a uniform orientation of the component, that is, the substrate 1 is maintained so that the conductors of the coplanar waveguide system are located on the top side of the substrate 1. For actual application, it is, however, beneficial to orient the substrate to be suitable for the individual method steps so that the substrate can be rotated for the different method steps by utilizing a suitable substrate carrier device.

As is also shown in FIG. l*e*, the photoresist layer 10 is radiated and developed, as is common with photolithographic methods. For example, the component can be exposed to ultraviolet (UV) light on its top side. It goes without saying that electron, x-ray, or ion beams can also be used as a radiation medium if the material is suitable. Under such radiation of the negative photolacquer, macromolecular bonds are disrupted or smaller molecules are polymerized, whereby, with a subsequent treatment, they remain as structured residue and are not removed from the component.

Figure 1F:
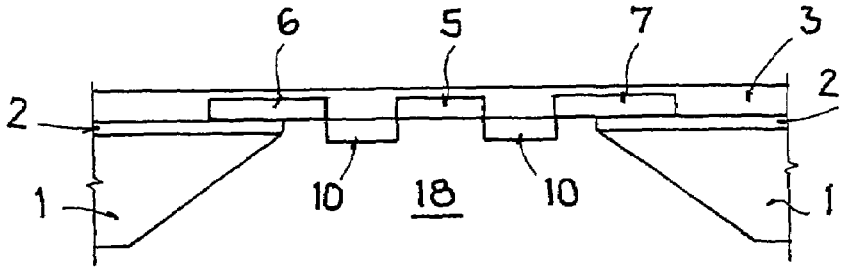

Subsequently, a development of the negative photolacquer 10 ensues in such a way that the exposed areas remain adhered to the bottom side of the membrane or second insulating layer 3 below the intermediate areas between the individual conductors 5, 6 and 7, whereas the non-exposed areas are removed, as is illustrated in FIG. 1*f*. The non-exposed segments of the negative photolacquer 10 are removed with a KOH solution, for example.

Figure 1G:
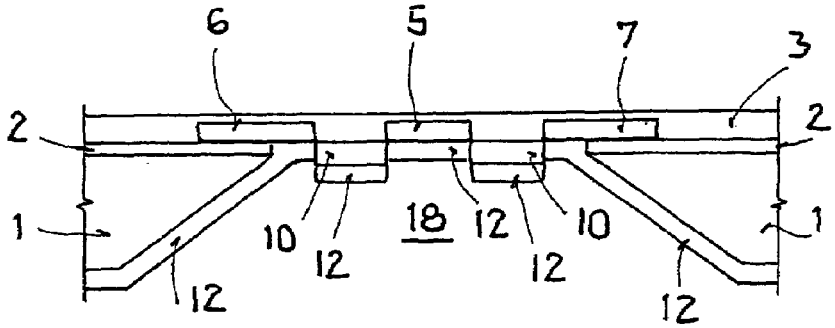

In a subsequent method step according to FIG. 1*g*, the bottom side of the substrate 1, that is, the back-etched area 18 is subjected to a remetallization. Thus, the structure that is illustrated in FIG. 1*g* is formed, whereby the lower metallization is beneficially directly connected with the upper grounding conductors 6 and 7, respectively, without a dielectric intermediate layer. It can also be seen in FIG. 1*g* that the thickness of the signal conductor 5 can be increased by the additional metallization 12 using a conventional metallization method, which reduces the electrical resistance of the signal conductor 5.

Figure 1H:
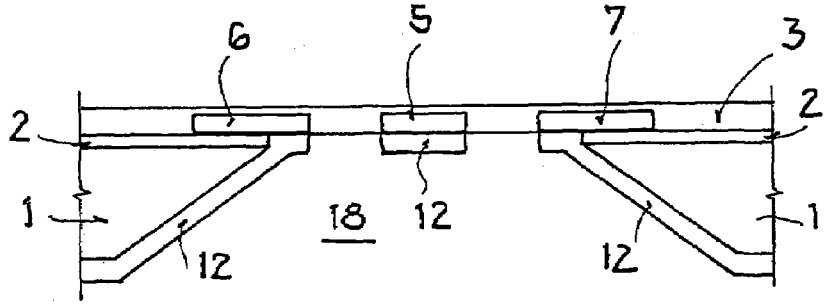

Subsequently, the remaining segments of the negative photolacquer 10 and the metal segments 12 deposited thereon are removed by using a suitable method, for example, an etching method utilizing an acetone solution, thereby achieving the structure illustrated in FIG. 1*h*.

Figure 1I:
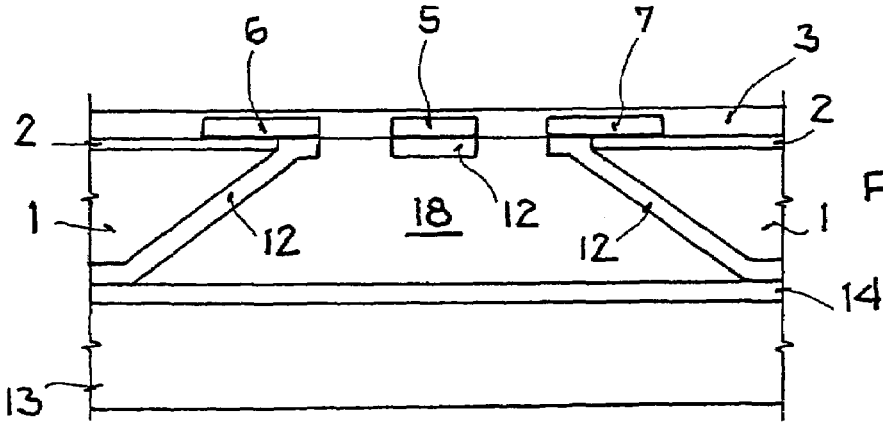

Lastly, an additional substrate 13 is preferably attached to the bottom side of the processed substrate 1 such that a completely closed hollow cavity, that is, a shielding area 18, is formed. As is illustrated in FIG. 1*i*, the additional substrate 13, which, for example, is made of the same material as the substrate 1, is provided with a metallization 14 on its top side with the result that the lower grounding conductor 12 is at least partially thickened. With this added electrical conductor, the additional substrate 13 can be connected, for example, to the processed substrate 1, that is, to the grounding conductor 12 that is provided on the bottom side of this substrate 1. Alternatively, a connection can also be made by annealing, that is, a heat treatment, or by a microwave treatment.

Due to the anisotropic back-etching of the substrate 1, as previously described, the oblique-shaped boundary area of the back-etched area 18 is formed. Therebelow, with reference to FIGS. 2*a* to 2*k*, a production method according to a second embodiment of the present invention is described, whereby the geometric limitations based on the diagonally back-etched areas 18 are reduced and adjacent coplanar waveguide systems can be arranged in closer proximity to one another without diminishing the mechanical stability of the component. With the below-described method, shielding hollow cavities with a higher integration density can be formed below the coplanar waveguide system without adding mechanical instability to the surface of the component.

Figure 2A:
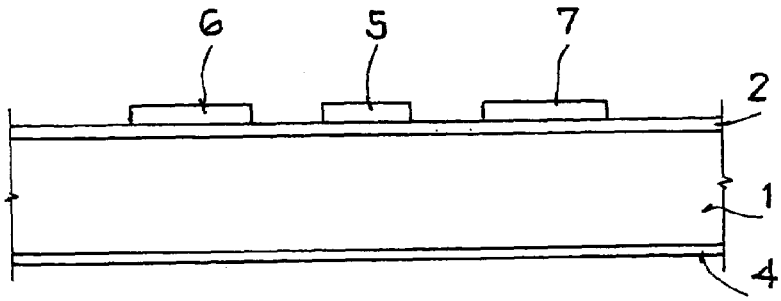
FIGS. 2*a* to 2*k* are cross-sectional views of a component of the present invention in various stages of the method to illustrate the individual method steps in accordance with a second embodiment of the present invention.

As can be seen in FIG. 2*a*, analogous to the first embodiment in a method step for the production of a finite ground coplanar waveguide (FGCPW), for example, a substrate 1 is provided on its top and bottom sides with a first dielectric insulating layer 2, that is, with an additional dielectric insulating layer 4 (henceforth referred to as third insulating layer 4), which can also be omitted. The substrate 1 is, for example, a low-resistance silicon semiconductor substrate or the like. Both the first and third dielectric insulating layers 2 or 4, can be formed, for example, as an approximately 1-2 μm-thick silicon nitride or silicon dioxide layer. Subsequently, a signal conductor 5 and two grounding conductors 6 and 7 are metallized on the first dielectric insulating layer 2 for the construction of the coplanar waveguide system. The grounding conductors 6 and 7, respectively, are positioned on the sides opposite from the signal conductor 5 and extend approximately parallel to the signal conductor 5. Aluminum has proven to be a particularly suitable material for the conductors 5, 6, and 7 of the coplanar waveguide system. However, other materials, for example, copper, gold, silver, titanium, or the like can also be used.

Figure 2B:
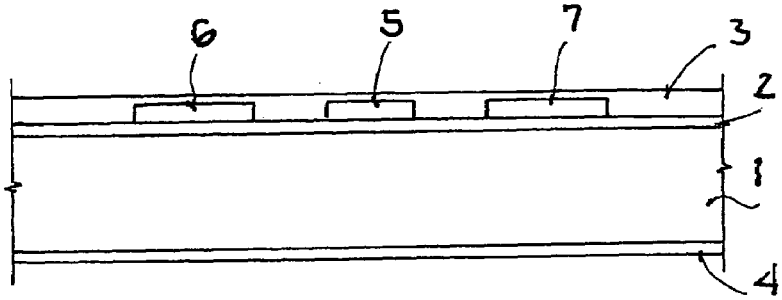

Next, as illustrated in FIG. 2*b*, analogous to the first embodiment, a second dielectric insulating layer 3 is formed over the first dielectric layer 2 and over the conductors 5, 6, and 7 of the coplanar waveguide system in such a way that the individual conductors 5, 6 and 7 are complete embedded in the second dielectric insulating layer 3.

As previously described, the second dielectric insulating layer 3 serves as a carrier membrane and is preferably made of the material SU-8, which is centrifuged onto the top side of the substrate 1, for example, and is subsequently subjected to a temperature treatment for hardening. SU-8 is a negative photolacquer, that is, a negative photoresist, which has excellent properties for microwave applications. It is noted at this point that it is very difficult to remove the SU-8 or second insulating layer 3 on the surface of the substrate 1 once it has been formed and hardened. Therefore, the SU-8 or second insulating layer 3 should be pre-structured and pre-etched in suitable areas for possible future metallizations. A further advantage of the SU-8 material is that it is robust against anisotropic etching solutions, for example, KOH. The second dielectric insulating layer 3 serving as a membrane can also be made, for example, of an organic insulation material, for example, a polymer material, particularly benzocyclobutene (BCB), a SiLK material, a polyimide, or the like.

Additionally, a protective layer can be applied to the second insulating layer 4, which preferably is resistant to agents, particularly etching agents that are used in further method steps, particularly etching agents, thus protecting the SU-8 layer.

In contrast to the first embodiment and as illustrated in FIGS. 1*a* to 1*i*, the back-etching of the substrate below the coplanar waveguide system is carried out in a staggered manner in two consecutive substrate etching processes such that below the conductors 5, 6, and 7 of the coplanar waveguide system, a beneficial staggered back-etched area is formed. This is described in more detail therebelow, with reference to FIGS. 2*c* to 2*k*.

Figure 2C:
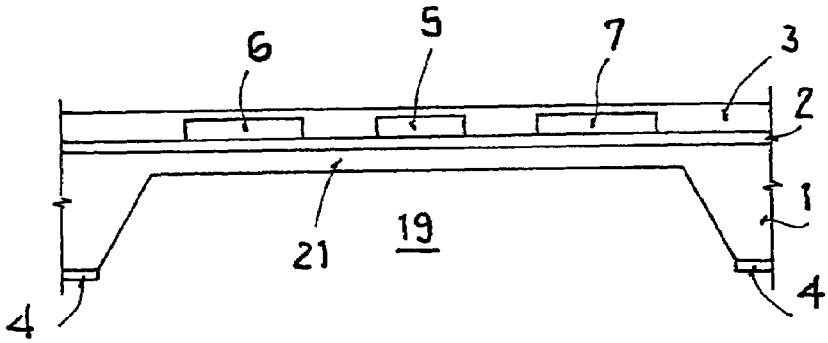

To start with, in a first substrate etching step, as illustrated in FIG. 2*c*, a first area 19 of the substrate 1 is back-etched in such a way that a thin substrate layer 21 of about 20-30 μm remains below the coplanar waveguide system. Thereby, the third dielectric insulating layer 4, for example, is used as a suitable mask for this etching process, analogous to the first embodiment.

Figure 2D:
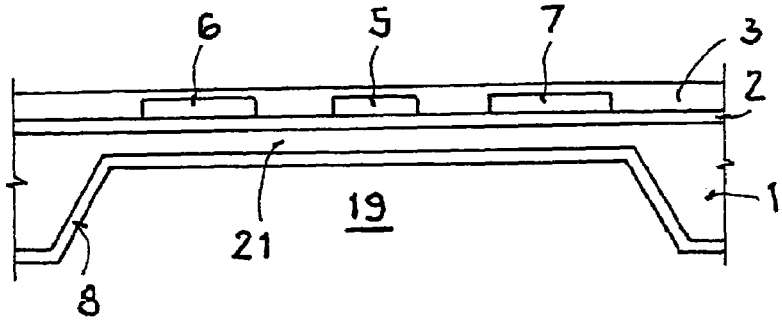

Subsequently, a fourth dielectric insulating layer 8 that is also made of, for example, silicon dioxide or silicon nitride, is deposited on the surface of the first back-etched area 19 by using a conventional deposition method. This is schematically illustrated in FIG. 2*d*.

Figure 2E:
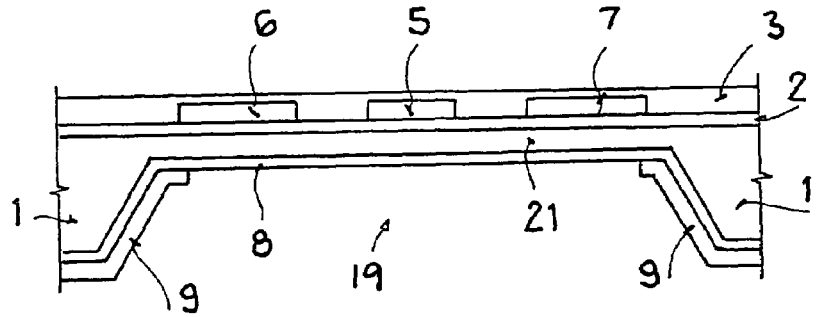

In a subsequent method step according to FIG. 2*e*, a first photoresist layer 9, for example, a photolacquer 9, is applied as a mask and developed.

Figure 2F:
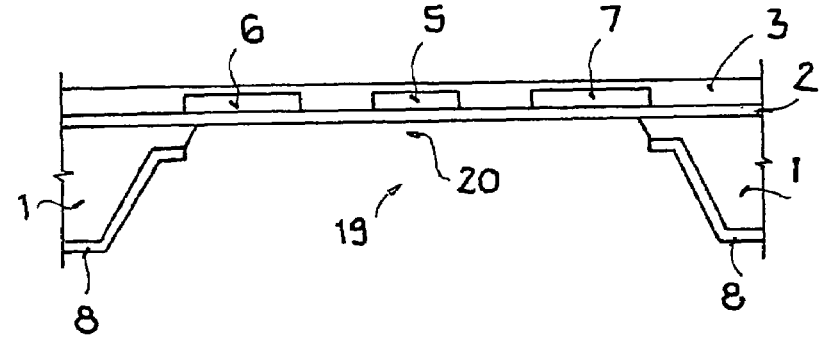

As can be seen in FIG. 2*f*, the fourth dielectric insulating layer 8 (see FIG. 2*d*), that is, the thin substrate layer 21 that was previously applied to the surface of the first back-etched area 19, is completely back-etched only in an area 20 utilizing the photo mask 9 below the conductors 5, 6, and 7, the width of the area 20 being approximately equal to the width of the coplanar waveguide system comprising conductors 5, 6, and 7, thus achieving the structure as illustrated in FIG. 2*f*. The first dielectric insulating layer 2 serves as protection of the conductors 5, 6, and 7 from the etching solution, for example, a KOH solution, during the etching process.

Figure 2G:
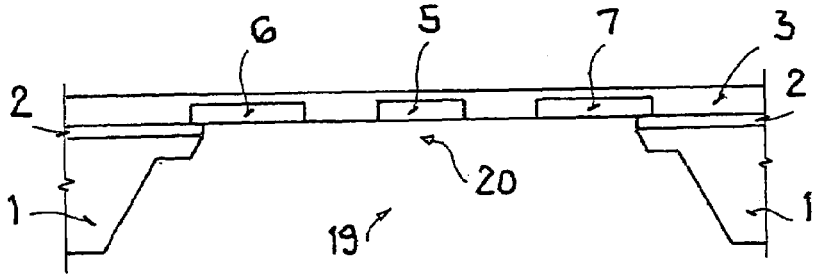

The remaining segments of the third dielectric insulating layer 4 on the bottom side of the substrate 1 and the area of the first dielectric insulating layer 2, which covers the completely back-etched area 20, are then removed by using a dry etching process, for example. This step is schematically illustrated in FIG. 2*g*.

Figure 2H:
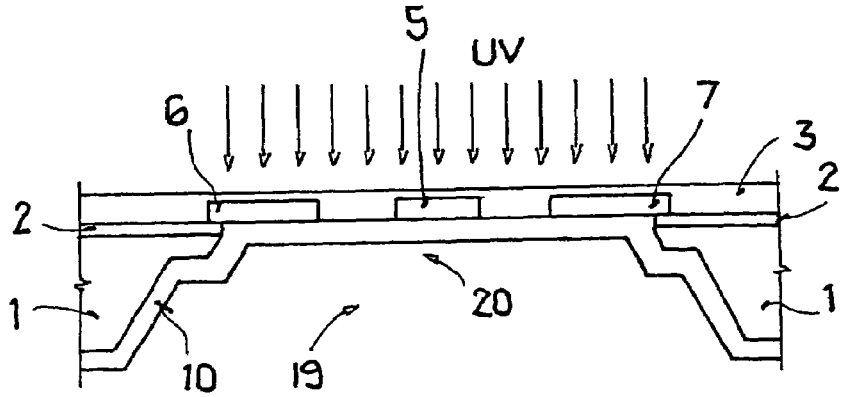

In a further step, as is illustrated in FIG. 2*h*, a photolacquer 10, for example, a negative photolacquer 10, is formed on the surface of the back-etched areas 19 and 20 and on the bottom side of the segment of the SU-8 layer that covers the completely back-etched area 20, starting at the bottom side of the substrate 1 and using, for example, a centrifugal technique. It will be obvious to one skilled in the art that instead of a negative photolacquer, a positive photolacquer with suitable method steps can be used vice versa.

It is noted at this point that, again, a uniform orientation of the component, that is, the substrate 1 is maintained in all figures so that the conductors of the coplanar waveguide system are located on the top side of the substrate 1. For actual application, it is, however, beneficial to orient the substrate to be appropriate for the individual method steps so that the substrate can be rotated for the different method steps by utilizing a suitable substrate carrier device.

It can also be seen in FIG. 2*h* that the photoresist layer 10, as is common in photolithographic procedures, is radiated, that is, developed as a mask. For example, the component can be exposed to ultraviolet (UV) rays from its top side. It goes without saying that if the materials are suitable; electron, x-ray or ion beams can also be used as a radiation medium. During radiation, macromolecular bonds are disrupted or smaller molecules are polymerized in the negative photolacquer, whereby, with a subsequent treatment, they remain as structured residue and are not removed from the component.

Figure 2I:
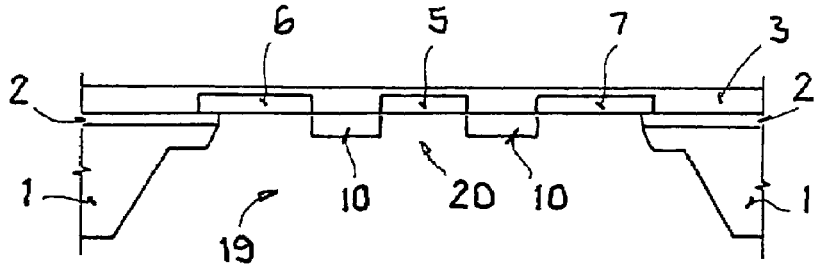

Subsequently, as is illustrated in FIG. 2*i*, the negative photolacquer 10 is developed In such a way that the exposed areas remain adhered to the bottom side of the membrane or second insulating layer 3 below the intermediate areas between the individual conductors 5, 6, and 7, whereas the non-exposed areas are removed. The non-exposed segments of the negative photoresist 10 are removed with a KOH solution, for example.

Figure 2J:
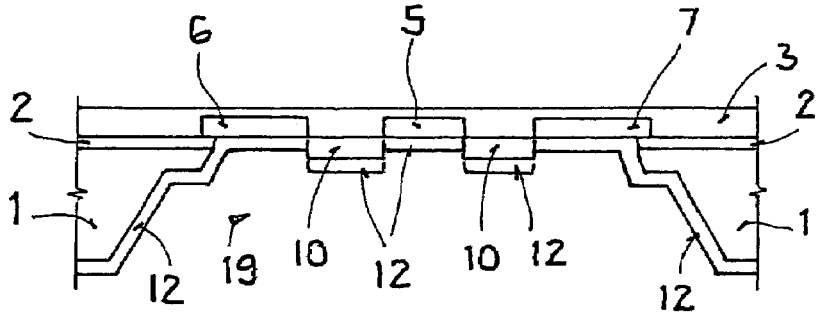

In a subsequent method step according to FIG. 2*j*, the bottom side of the substrate 1, that is, of the back-etched areas 19 and 20, is subjected to a remetallization. In this way, the structure illustrated in FIG. 2*j* is formed, whereby the lower metallization is directly beneficially connected with each of the upper grounding conductors 6 and 7 without a dielectric intermediate layer. It can also be seen in FIG. 2*j* that by adding the metallization 12 using a standard metallization technique, the thickness of the signal conductor 5 can be increased, thereby reducing the electrical resistance of the signal conductor 5.

Figure 2K:
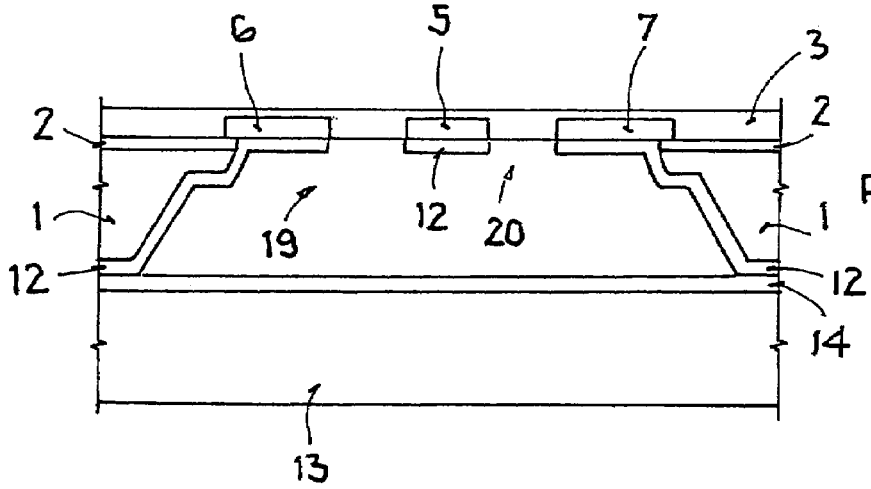

Next, as is shown in FIG. 2*k*, the remaining segments of the negative photolacquer 10 and the metal segments 12 deposited thereon are removed by using an appropriate procedure, for example, an acetone solution.

Finally, an additional substrate 13 is preferably attached to the bottom side of the processed substrate 1 such that a completely closed hollow cavity, that is, a shielding area 19, 20 is formed. As is illustrated in FIG. 2*k*, the additional substrate 13, which, for example, is also made of the same material as the substrate 1, is provided with a metallization 14 on its top side, thus increasing the thickness of the lower grounding conductor 12, at least in part. With this added electrical conductor, the additional substrate 13 can, for example, be connected to the processed substrate 1, that is, to the grounding conductor 12 that is provided on the bottom side of this substrate 1. Alternatively, a connection can also be made by annealing, that is, a heat treatment, or by a microwave treatment.

Therefore, the individual coplanar wave guides to not need to be fabricated separately and subsequently interconnected using, for example, a "flip-chip technology." Instead, they can be produced all at once on a substrate using a uniform and thus more cost-effective method.

Figure 3A:
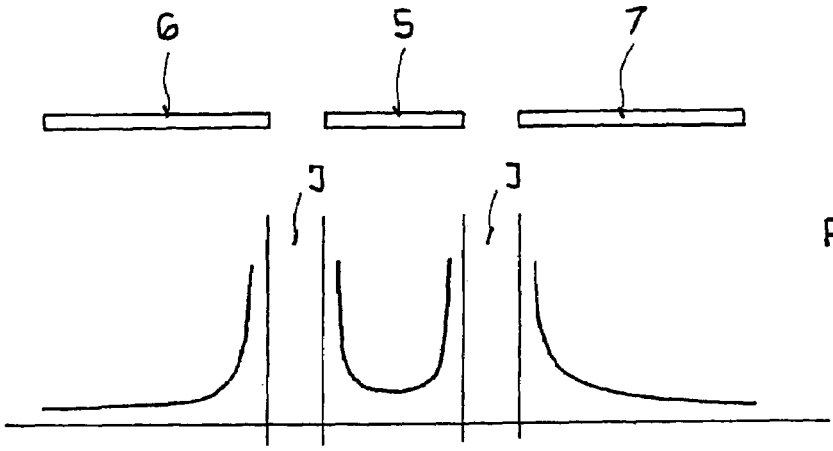
FIG. 3*a* is a schematic illustration of a current density distribution in a coplanar waveguide system.

FIG. 3*a* is a graphic illustration of the current density distribution of a conventional coplanar wave guide comprising a signal conductor 5 and two grounding conductors 6 and 7 arranged in parallel with the signal conductor. As is shown in FIG. 3*a*, the signal conductor 5 has the highest current density J in the areas facing the respective grounding conductors 6 and 7, and the grounding conductors 6 and 7, respectively, have the highest current density J in the area facing the signal conductor 5.

Figure 3B:
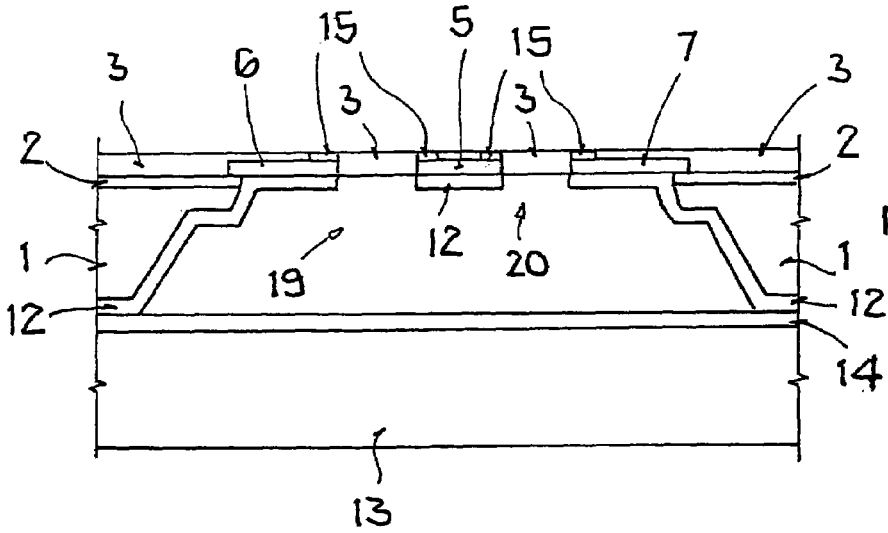
FIG. 3*b* is a cross-sectional view of a component in accordance with a third embodiment of the present invention.

This factor is taken into consideration in the present invention such that the areas with the highest current density J of the conductors 5, 6 and 7 of the coplanar waveguide system are provided with an additional metallization 15, as is illustrated in FIG. 3*b*. With this increase in thickness, the conductivity is increased in these areas and conforms to the increased current density J.

As has been previously described, it is preferable that at the beginning of the production process when the second dielectric layer, that is, the membrane or second insulating layer 3 is formed, to provide the membrane with suitable structures for such an additional thickening metallization 15 because processing of the hardened membrane or second insulating layer 3 at a later time is difficult to accomplish.

It goes without saying that thicknesses such as these can be used in the production process of both the first and the second embodiment.

FIG. 4 illustrates a cross-sectional view of a component according to a fourth embodiment of the present invention. The component includes, for example, two coplanar waveguides that are arranged adjacent to one another, which are simultaneously constructed on the substrate 1 in collective method steps in accordance to the second embodiment.

It is preferred according to the present embodiment that, in contrast to the second embodiment, the geometry of the second substrate 13 is such that it can be roughly foreclosed inserted in the first back-etched area 19. In this way, an extremely compact structural form is realized, where air gaps 20 below the respective coplanar waveguide systems are still provided.

It is preferable that the surface of the second substrate 13 is also provided with a metallization 14, which at least in part is firmly connected to the lower metallization 12 of the processed substrate 1. As an additional result, a common electrical connection of all grounding conductors is achieved so that only a common mass connection is required.

As is shown in FIG. 4, the two adjacent coplanar waveguide systems are separated from one another by a thin substrate layer 21, whereby a mechanically stable construction is attained. Furthermore, by foreclosed insertion of the additional substrate 13 in the first back-etched area 19, the thin substrate layer 21 between the two adjacent coplanar waveguide systems is further supported so that all in all, the mechanical stability of the component is considerably improved.

FIG. 5 illustrates a cross-sectional view of the component according to a fifth embodiment of the present invention. As is shown in FIG. 5, a covering metallization 16 is additionally formed over the coplanar waveguide system, whereby the respective rim regions of the covering metallization 16 are connected with the outer areas of the two grounding conductors 6 and 7. In this way, a closed system to protect the signal conductor from external interferences and dirt is constructed. In addition, the covering metallization 16 is thus arranged for a common electrical connection of all grounding conductors so that only a common mass connection is required.

FIG. 6 illustrates a sixth embodiment of a component in cross-sectional view, whereby once again two coplanar waveguide systems having a covering metallization 16 are arranged adjacent to one another on a shared substrate.

It is noted at this point that the characteristic features of the components of the individual embodiments can be combined at will so that an application-specific component can be constructed.

Although the present invention has been described with reference to preferred embodiments, it is not limited to those embodiments but can be modified in a variety of ways.

For example, different materials can be used for the individual conductors of the coplanar waveguide system, for the substrate, and for the individual dielectric insulating layers. Furthermore, different conventional methods can be employed for structuring, back-etching of the substrate, removal of residual coatings, etc. It goes without saying that any number of coplanar wave guides can be provided, depending on the substrate area at disposal.

Thus, the present invention provides a component and a production method for such a component for the transmission of electromagnetic waves, which, in contrast to conventional production methods, can be executed with less expenditure because the conventional tri-layer method $SiO_2$—$Si_3N_4$—$SiO_2$ can be replaced by a single dielectric membrane, which in addition forms a covering for the individual conductors. According to the present invention, no masks for photolithographic processes are necessary for the fabrication of the membranes. Therefore, the present production method is simpler, faster and more cost-effective.

Furthermore, a component can be produced in a simple way with the present production method, whereby all the grounding conductors are directly connected with one another such that only one single connection point for grounding is needed. In addition, the thickness of the signal conductor is increased in a simple manner so that the resistance of the signal conductor is reduced.

The production method of the present invention is suitable for the production of a plurality of coplanar waveguide systems on a shared substrate and in integrated circuits, particularly in the high-frequency field, because the substrate has a stable structure despite the fact that decoupling air gaps are formed below the coplanar wave guides. This structure has the advantage that by embedding in the SU-8 membrane or second insulating layer 3, the signal conductor 5 is suspended freely and without obstructions across the hollow cavity, that is, the back-etched area 18, so that a complete decoupling from the substrate is ensured. The grounding conductors are, for the most part, also supported over the back-etched areas by embedding in the membrane and are thus mostly decoupled from adjacent components.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for producing a coplanar waveguide system on a substrate for the transmission of electromagnetic waves, the method comprising:

providing the coplanar waveguide system that includes a signal conductor and at least two grounding conductors on a predefined area of the substrate;

forming a first dielectric insulating layer over the signal conductor and the at least two grounding conductors of the coplanar waveguide system;

back-etching of an area of the substrate below the coplanar waveguide system such that the signal conductor of the coplanar waveguide system is supported completely and each of the at least two grounding conductors are supported at least partially by embedment in the first dielectric insulating layer; and structured metallization of the surface of the back-etched area of the substrate and of a lower surfaces of the signal conductor and of at least a portion of lower surfaces of the at least two grounding conductors and of the coplanar waveguide system, which are located above the back-etched area, thereby forming the signal conductor with an increased thickness and said at least two grounding conductors at least partially thickened.

2. The method according to claim 1, wherein a third dielectric layer is provided on a lower surface of the substrate, the third dielectric layer being comprised of an inorganic insulation material.

3. The method according to claim 1, wherein, by the structured metallization, lower grounding conductors are formed, each lower grounding conductor being connected with a segment of a corresponding grounding conductor of the coplanar waveguide system, the segments being located above the back-etched area of the substrate.

4. The method according to claim 1, wherein an additional substrate is attached to a lower surface of the substrate thereby forming a hollow cavity between at least the back-etched area of the substrate and the additional substrate.

5. The method according to claim 4, wherein the additional substrate has a metallization on an upper surface thereof that is at least partially connected with lower grounding conductors.

6. The method according claim 4, wherein the additional substrate is formed so that it can be inserted to interlock, at least partially, in a partially back-etched area.

7. The method according to claim 1, wherein the step of back-etching the area of the substrate below the coplanar waveguide system is performed in two consecutive substrate etching steps, wherein, in a first etching step, a portion of the substrate below the coplanar waveguide system is partially back-etched for forming a thin substrate layer below the signal conductor and the at least two grounding conductors, and wherein, in a subsequent second etching step, a segment of the thin substrate layer below the signal conductor and the at least two grounding conductors is further back-etched for forming a staggered structure of the back-etched area of the substrate.

8. The method according to claim 7, wherein the first etching step is performed by a wet chemical etching procedure.

9. The method according to claim 7, wherein the second etching step includes a disposition of an additional insulating layer on the lower surface of the substrate and on a surface of the partially back-etched segment and a structuring of the additional insulating layer by developing a vapor-deposited photoresist for the structured back-etching of the segment of the thin substrate layer.

10. The method according to claim 9, wherein the photoresist is subsequently removed.

11. The method according to claim 10, wherein, prior to the application of the photoresist for the structured metallization, the remaining additional insulating layer is removed by a dry etching procedure.

12. The method according to claim 1, wherein the step of back-etching the area of the substrate below the coplanar waveguide system is performed in one single anisotropic substrate etching step.

13. The method according to claim 1, wherein the signal conductor and the at least two grounding conductors of the coplanar waveguide system are made of aluminum, copper, silver, gold, or titanium.

14. The method according to claim 1, wherein, prior to the step of structured metallization, a photoresist layer is formed on the surface of the back-etched area of the substrate and is irradiated.

15. The method according to claim 1, wherein the signal conductor, to increase a thickness thereof, is additionally metallized in areas facing the at least two grounding conductors.

16. The method according to claim 1, wherein each of the at least two grounding conductors is additionally metallized in an area facing the signal conductor to increase a thickness of each of the at least two grounding conductors.

17. The method according to claim 1, wherein a covering metallization is formed over the coplanar waveguide system and extends from one grounding conductor to another grounding conductor of the at least two grounding conductors to electrically connect them with one another, and wherein the covering metallization is formed in the shape of a lid.

18. The method according to claim 1, wherein a plurality of coplanar waveguide systems are further provided on the substrate adjacent to one another, wherein the substrate is subjected to collective substrate etching steps for forming back-etched areas below each one of the plurality of corresponding coplanar waveguide systems.

19. The method according to claim 18, wherein grounding conductors of adjacent coplanar waveguide systems facing each other are electrically connected with one another via a lower grounding conductor, which is formed by structured metallization.

20. The method according to claim 1, wherein the substrate is a silicon semiconductor substrate.

21. The method according to claim 1, wherein the signal conductor and/or the at least two grounding conductors of the coplanar waveguide system are coplanar waveguides that are used in a high frequency field.

22. The method according to claim 1, wherein the first dielectric insulation layer is formed as a membrane that is made of an organic insulation material, an organic polymer material, benzocyclobutene, SU-8, SiLK, or a polyimide.

23. The method according to claim 1, wherein a second dielectric insulating layer is formed on an upper surface of the substrate prior to the step of providing of the signal conductor and the at least two grounding conductors.

24. The method according to claim 23, wherein the second dielectric insulating layer is made of an inorganic insulation material, a silicon oxide, a silicon dioxide, silicon with air gaps, or silicon nitride.

25. The method according to claim 23, further comprising the step of removing the second insulating layer in a segment of the back-etched area of the substrate by a dry etching procedure, prior to a step of applying a photoresist for the structured metallization.

26. A component for transmitting electromagnetic waves, the component comprising:

a substrate, which on a lower surface thereof has a back-etched area;

a first dielectric insulating layer, which is provided on an upper surface of the substrate and which extends across the back-etched area;

at least one coplanar waveguide system, which includes a signal conductor and at least two grounding conductors, the signal conductor being completely and the at least two grounding conductors being at least partially suspended across the back-etched area of the substrate by being embedded in the first dielectric insulating layer; and a metallization that is applied from the lower surface of the substrate on a surface of the back-etched area of the substrate and on segments of the signal and at least two grounding conductors of the coplanar waveguide system that are located above the back-etched areas for providing the signal conductor with an increased thickness and said at least two grounding conductors being at least partially thickened.

27. The component according to claim 26, wherein an additional substrate is attached to the lower surface of the substrate to thereby provide a hollow cavity with the back-etched area.

28. The component according to claim 27, wherein the additional substrate is formed so as to be inserted and at least partially interlocked in the back-etched area.

29. The component according to claim 27, wherein the additional substrate has a metallized surface, a portion thereof being connectable to the metallization applied to the lower surface of the substrate.

30. The component according to at least one of claim 27, wherein a second dielectric insulating layer is comprised of an inorganic insulation material, a silicon oxide, a silicon dioxide, a silicon nitride, or silicon with buried air gaps.

31. The component according to claim 27, wherein a covering metallization is provided over the coplanar waveguide system and extends from one of the at least two grounding conductors to an opposite one of the at least two grounding conductors, and which covers the signal conductor completely.

32. The component according to claim 27, wherein a plurality of coplanar waveguide systems are further provided on the substrate adjacent to one another, wherein the substrate is subjected to collective substrate etching steps for forming back-etched areas below each one of the plurality of coplanar waveguide systems.

33. The component according to claim 32, wherein each grounding conductor of adjacent coplanar waveguide systems facing each other is electrically connected with one another via a lower grounding conductor that was formed by structured metallization.

34. The component according to claim 26, wherein the substrate is a silicon semiconductor substrate.

35. The component according to claim 27, wherein each of the at least two grounding conductors, in an area thereof facing the signal conductor, is provided with an additional metallization for increasing the thickness thereof.

36. The component according to claim 26, wherein the first dielectric insulation layer is formed as a membrane that is comprised of an organic insulation material, an organic polymer material, benzocyclobutene, SU-8, SiLK, or a polyimide.

37. The component according to claim 26, wherein the signal conductor and/or the tow ground conductors are comprised of aluminum, copper, silver, gold, or titanium.

38. The component according to claim 26, wherein the coplanar waveguide system is constructed as a coplanar wave guide for use in a high frequency field.

39. The component according to claim 27, wherein additional metallization is provided on the signal conductor in areas thereof that face the at least two grounding conductors for increasing the thickness of the signal conductor.

* * * * *